United States Patent [19]

Minneman

[11] Patent Number: 4,481,964

[45] Date of Patent: Nov. 13, 1984

[54] COMBINATION WALKING STICK AND SHOOTING REST

[75] Inventor: William J. Minneman, Clayton, Ohio

[73] Assignee: MTM Molded Products Company, Dayton, Ohio

[21] Appl. No.: 416,814

[22] Filed: Sep. 13, 1982

[51] Int. Cl.[3] ..... A45B 5/00

[52] U.S. Cl. ..... 135/66; 272/70.1

[58] Field of Search ..... 135/66; 272/70.1, 70.2; 248/155, 155.1, 155.2, 155.3, 222.2, 354 S, 27.5, 122, 455, 456, 530, 532; 211/64, 125

[56] References Cited

U.S. PATENT DOCUMENTS

| | | | |
|---|---|---|---|
| 368,823 | 8/1887 | Fowler | 135/66 |
| 441,016 | 3/1891 | Fuchs | 135/66 |
| 521,811 | 6/1894 | Piepenbring | 272/70.1 |
| 738,240 | 9/1903 | Roberts | 272/70.2 |
| 2,504,922 | 4/1950 | Dowell | 272/70.1 |
| 3,991,780 | 11/1976 | Maroski, Jr. | 135/66 |
| 4,071,243 | 1/1978 | Fink | 272/70.1 |

FOREIGN PATENT DOCUMENTS

| | | | |
|---|---|---|---|
| 343914 | 7/1906 | France | 135/66 |
| 868541 | 5/1961 | United Kingdom | 135/66 |

*Primary Examiner*—Robert A. Hafer
*Assistant Examiner*—Arnold W. Kramer
*Attorney, Agent, or Firm*—Biebel, French & Nauman

[57] ABSTRACT

A combination walking stick and shooting rest comprises a generally L-shaped body having an elongated first member and a second member extending generally perpendicular to the first member at one end. A plurality of serrations extend along the forward and rearward edge of the elongated first member. An adjustable shooting support includes a rectangular aperture through one end thereof which receives the first member. The support can be moved along the first member when oriented generally perpendicular thereto. Once located at a desired position along the first member, the support is canted to engage the serrations and provide support at the selected location. The end of the elongated first member opposite to the second member is tapered to a point for insertion into the ground. The second member includes an upwardly concave surface which serves as a fixed support and also accommodates the palm of a user's hand. The adjustable shooting support includes an upwardly curved surface for receiving and supporting a shooting device.

9 Claims, 4 Drawing Figures

COMBINATION WALKING STICK AND SHOOTING REST

BACKGROUND OF THE INVENTION

The present invention relates generally to walking sticks and, more particularly, to a walking stick which is adapted to provide both a fixed and an adjustable shooting rest.

Hunters, marksmen and photographers oftentimes need a field support for a gun or camera to obtain an accurate shot. Whether the shot is to drop an animal, maintain a tight pattern on a target or to obtain a crisply focused photogaph, the stability of the shooting device is all-important. Stability is particularly required for the use of high power telescopic sights and telephoto lenses.

In the field, precision shooting benches and most photographic tripods are too heavy, complicated or cumbersome for a shooter to conveniently carry. This is especially true in rugged areas where it may even be advantageous to have a walking stick to traverse the territory. Accordingly, in such field situations, hunters, marksmen and photographers have to rely upon finding a convenient tree, rock or the like against which to rest the shooting device for stability. Since sunch fixed stabilizing objects are often not conveniently available when the need for a shooting rest arises, many shots with both cameras and firearms are either lost or shot accuracy is compromised.

It is, thus, apparent that the need exists for a lightweight shooting rest which can be conveniently carried into the field and quickly positioned to provide a shooting rest for both firearms and cameras.

SUMMARY OF THE INVENTION

In accordance with the present invention, both a fixed and an adjustable shooting rest are incorporated into a walking stick. The resulting shooter's walking stick is highly portable and light in weight being preferably molded of ABS plastic. The shooter's walking stick comprises a generally L-shaped body having an elongated first member and a second member extending generally perpendicular to the first member at one end. A plurality of serrations extend along the first member and shooting support means may be moved along the first member to selectively engage the serrations for defining a plurality of support positions.

The serrations are formed along at least the rearward edge of the first member of the L-shaped body, i.e., the edge facing toward the second member. Stated another way, the serrations face a person who would be using the device as a walking stick or cane when the person was grasping the second member in his hand as a handle or head of the walking stick or cane. Preferably, the serrations are smoothly formed scallops and extend onto the underside of the second member to form finger gripping positions on the second member or handle of the device when it is used as a walking stick or cane. Preferably, the serrations are also formed on the forward edge of the first member to more positively define and support the shooting support means in the plurality of support positions.

The end of the first member opposite to the end where the second member or handle attaches is tapered to a point or otherwise sharpened for insertion into the ground.

The shooting support means comprises a third member which has a generally rectangular opening which receives the first member. The opening has end faces shaped to conformally engage the serrations on the first member. One end face extends above a lateral center line of the third member while the other extends below the lateral center line. This formation permits the third member to be moved along the first member when the lateral center line is oriented generally perpendicular thereto but to be fixed in a plurality of support positions along said first member when the lateral center line is canted relative thereto.

The handle or second member of the shooter's walking stick is indented to provide an upper concave surface which serves as a fixed position support and accommodates the palm of one's hand when being used as a walking stick or cane.

In the preferred embodiment of the present invention, the shooter's walking stick is further reduced in weight by being made up of a thin web or rib which has perpendicularly extending flanges centered on the rib and extending around it. Similarly, the shooting support means or third member comprises a curved web or rib having reinforcing flanges extending from its sides in a generally perpendicular orientation from the curved rib with the end faces formed into extensions of the curved rib.

It is, therefore, an object of the present invention to provide a lightweight shooter's walking stick which provides an upper fixed shooting rest and a lower adjustable shooting rest.

Other objects and advantages of the invention will be apparent from the following description, the accompanying drawings and the appended claims.

DETAILED DESCRIPTION OF THE INVENTION

Figure 1:
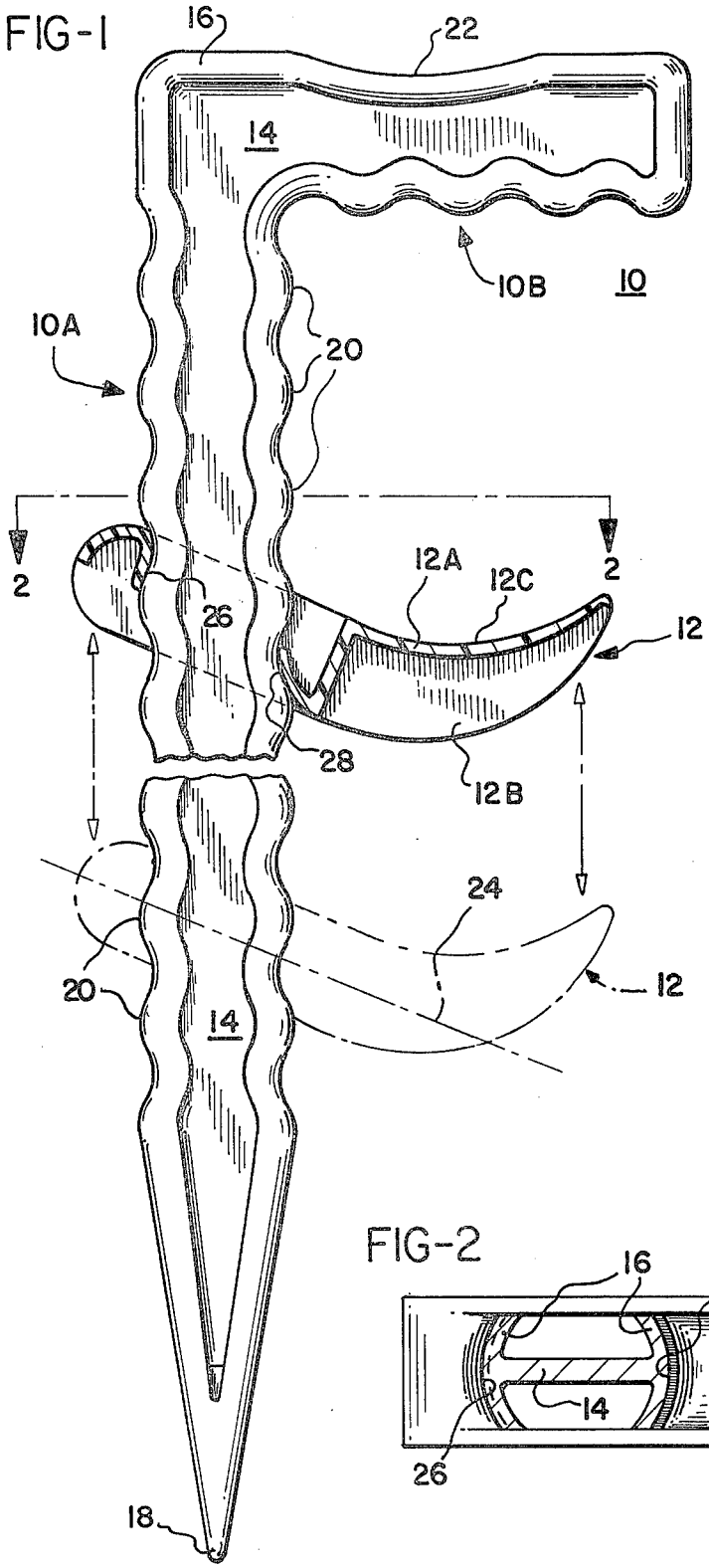
FIG. 1 is a partially sectioned side elevational view of the shooter's walking stick in accordance with the present invention.
Figure 2:
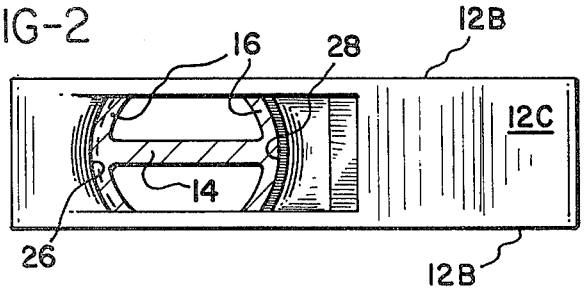
FIG. 2 is a sectional view taken along the line 2—2 in FIG. 1.

A shooter's walking stick 10 in accordance with the present invention is shown in side elevational view in FIG. 1. The shooter's walking stick 10 comprises a generally L-shaped body having an elongated first member 10A and a second member 10B extending in a generally perpendicular direction from one end of the first elongated member 10A. A third member or adjustable support 12, shown in cross section, extends over the elongated first member 10A. To provide minimum weight, the L-shaped body comprises a rib or web 14 with a flange 16 centered on the rib 14 and extending entirely therearound (see FIG. 2). Similarly, the support 12 is formed as a curved rib 12A with reinforcing flanges 12B extending in a generally perpendicular direction to the curved rib 12A.

Figure 3:
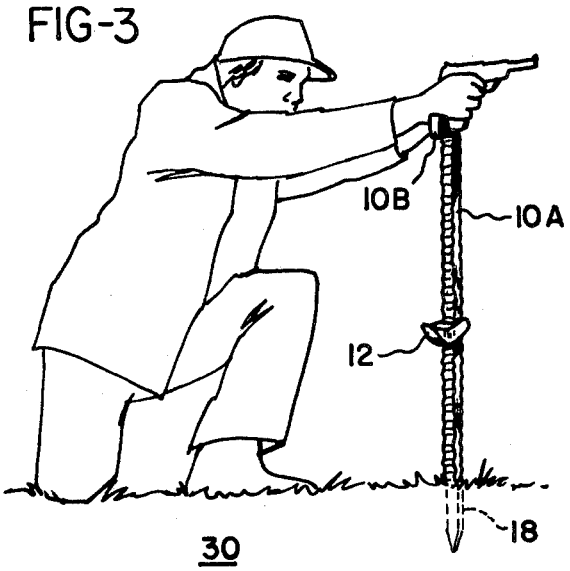
FIGS. 3 and 4 are perspective views showing the shooter's walking stick in use.
Figure 4:
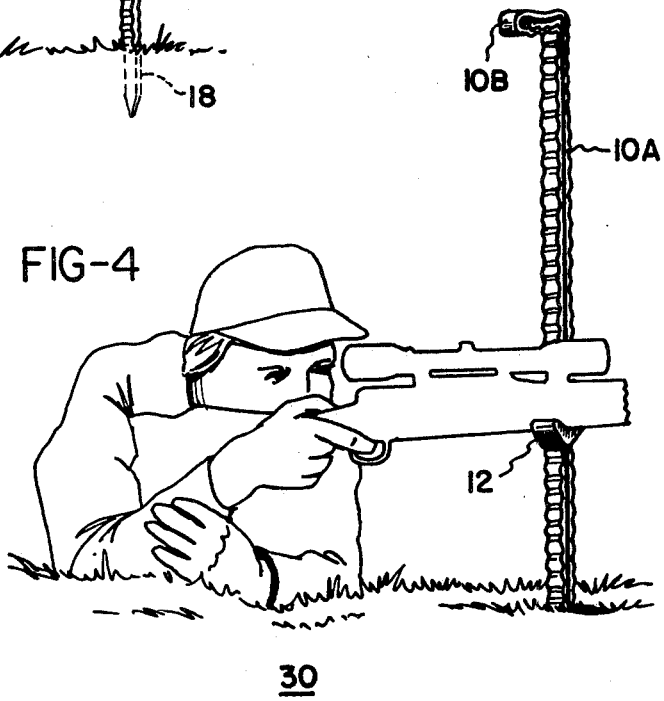

The rib 14 and flange 16 are tapered to a point 18 at the end of the elongated first member 10A opposite to the second member 10B or handle of the walking stick 10. As shown in FIGS. 3 and 4, the point 18 permits the elongated first member 10A of the walking stick 10 to be inserted into the ground to provide a stable support either on the horizontally extending second member 10B at a fixed position above the ground or at an adjustable position above the ground on the support 12.

In the preferred embodiment, the flange 16 is formed into serrations 20 on both the rearward edge of the elongated first member 10A, i.e., the edge toward the second member 10B, and on the forward edge of the elongated first member 10A, i.e., the edge opposite to the second member 10B. These serrations are smooth scallops in the preferred embodiment and extend onto the undersurface of the second member 10B to serve as finger-gripping positions when the second member 10B is used as a handle for the walking stick 10. The upper surface of the second member 10B is indented to provide a concave upwardly facing surface 22 which serves as a fixed support and also accommodates the palm of a user's hand when used as a walking stick or cane.

The serrations 20 on the flange 16 of the elongated first member 10A of the walking stick 10 provide for adjustably positioning and supporting the adjustable support 12 along the member 10A. When the right-hand end of the support 12, as shown in FIG. 1, is raised so that the center line 24 is approximately perpendicular to the elongated first member 10A, the support 12 can be moved along the elongated member 10A over the serrations 20. When the support 12 is once again canted to the position shown in FIG. 1, end faces 26, 28 engage the serrations 20, respectively, opposite to the end faces to maintain the support 12 in the position shown. Once the support 12 is canted, it provides stable support for a firearm or camera cradled in a concave, upwardly curving support surface 12C of the support member 12.

As shown in FIGS. 3 and 4, once the pointed end of the elongated first member 10A is inserted firmly into the ground 30, the second member 10B can be used as a fixed support and the support 12 can be adjusted to provide support at selected positions along the elongated first member 10A. Preferably, the combination walking stick shooting support of the present invention is molded from ABS plastic to provide a strong and durable structure which is light in weight.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A shooter's walking stick comprising:

a generally L-shaped body having an elongated first member and a second member extending in an approximately perpendicular direction from one end of said first member;

a plurality of uniformly shaped scallops evenly formed along a substantial portion of said elongated first member and continuing onto the adjacent edge of said second member to form finger gripping positions on said second member; and shooting support means for selectively engaging said plurality of scallops and comprising a third member having an aperture formed therein for receiving said elongated first member, said aperture having end faces conforming to said scallops and being spaced such that said third member slides over said scallops at a first defined orientation of said third member to said first member and engages said scallops at a second defined orientation of said third member to said first member to define a plurality of support positions along said elongated first member.

2. The shooter's walking stick of claim 1 wherein the end of said first member opposite to said one end is tapered to a point for insertion into the ground.

3. The shooter's walking stick of claim 2 wherein said third member defines a concave support surface when positioned in said second defined orientation.

4. The shooter's walking stick of claim 3 wherein said second member has a concave upper surface to serve as a fixed support surface and to accommodate the palm of one's hand.

5. The shooter's walking stick of claim 4 wherein said L-shaped body and said shooting support means are formed from plastic.

6. A lightweight shooter's walking stick comprising:

a generally L-shaped body having an elongated first member and a second member extending in a generally perpendicular direction from one end thereof, said body comprising a rib with a reinforcing flange centered upon said rib and extending therearound;

a plurality of serrations formed into said flange on the rearward edge of said first member which faces toward said second member, the underside of said second member which faces toward said first member, and on the forward side of said first member which is opposite to said second member; and a support comprising a curved rib having reinforcing flanges extending in a generally perpendicular direction from said curved rib at the outer edges thereof, said curved rib having a generally rectangular opening toward one end thereof for slidingly receiving said first member when generally perpendicular to said first member and for securely engaging said serrations on the forward and rearward edges of said first member when canted relative thereto whereby said support can be adjustably positioned along said first member.

7. The lightweight shooter's walking stick of claim 6 wherein said rib and said reinforcing flange on said first number taper to a point at the end opposite to said one end.

8. The lightweight shooter's walking stick of claim 7 wherein said rib and flange are indented along the upper surface of said second member to form a fixed support surface and to accommodate the palm of one's hand.

9. The lightweight shooter's walking stick of claim 8 wherein said L-shaped body and said support are molded from plastic.

* * * * *